US010184309B2

(12) United States Patent
Crow

(10) Patent No.: US 10,184,309 B2
(45) Date of Patent: Jan. 22, 2019

(54) RUNNING TOOL FOR RECESS MOUNTED ADAPTIVE SEAT SUPPORT FOR AN ISOLATING OBJECT FOR BOREHOLE TREATMENT

(71) Applicant: Stephen L. Crow, Humble, TX (US)

(72) Inventor: Stephen L. Crow, Humble, TX (US)

( * ) Notice: Subject to any disclaimer, the term of this patent is extended or adjusted under 35 U.S.C. 154(b) by 0 days.

(21) Appl. No.: 15/586,553

(22) Filed: May 4, 2017

(65) Prior Publication Data

US 2017/0321507 A1 Nov. 9, 2017

Related U.S. Application Data

(60) Provisional application No. 62/332,708, filed on May 6, 2016.

(51) Int. Cl.

| | |
|---|---|
| ***E21B 23/06*** | (2006.01) |
| ***E21B 33/12*** | (2006.01) |
| *E21B 43/26* | (2006.01) |

(52) U.S. Cl.

CPC ..... *E21B 23/06* (2013.01); *E21B 33/12* (2013.01); *E21B 33/1208* (2013.01); *E21B 43/26* (2013.01)

(58) Field of Classification Search

CPC ..... E21B 23/06; E21B 33/12; E21B 33/1208; E21B 43/26

See application file for complete search history.

(56) References Cited

U.S. PATENT DOCUMENTS

| | | | | |
|---|---|---|---|---|
| 4,911,237 | A | 3/1990 | Melenyzer | |
| 9,482,071 | B2 | 11/2016 | Carrejo et al. | |
| 9,556,704 | B2 | 1/2017 | Naedler et al. | |
| 2004/0175229 | A1 | 9/2004 | Balsells | |
| 2009/0159293 | A1 | 6/2009 | Jones et al. | |
| 2012/0012771 | A1 | 1/2012 | Korkmaz et al. | |
| 2012/0067583 | A1* | 3/2012 | Zimmerman | E21B 34/14 166/308.1 |
| 2014/0060813 | A1 | 3/2014 | Naedler et al. | |
| 2015/0101823 | A1 | 4/2015 | Carrejo et al. | |
| 2017/0226837 | A1* | 8/2017 | Kumar | E21B 23/01 |

FOREIGN PATENT DOCUMENTS

| | | | |
|---|---|---|---|
| WO | 2015084479 | A1 | 6/2015 |
| WO | 2016049771 | A1 | 4/2016 |

OTHER PUBLICATIONS

PCT International Search Report and Written Opinion dated Jul. 21, 2017 (copy attached).

* cited by examiner

*Primary Examiner* — D. Andrews
*Assistant Examiner* — Yanick A Akaragwe
(74) *Attorney, Agent, or Firm* — Steve Rosenblatt

(57) ABSTRACT

A coiled adaptive seat is held to a smaller diameter for delivery with a tool that can feature a locating lug for desired alignment of the seat with an intended groove in the inner wall of a tubular. The release tool retracts a cover from the seat allowing its diameter to increase as it enters a groove. Alternatively the adaptive seat is released near the groove and pushed axially in the string to the groove for fixation. Once in the groove the inside diameter of the string is a support for a blocking object so that sequential treatment of parts of a zone can be accomplished. The blocking object is removed with pressure, dissolving, milling or disintegration leaving a narrow ledge in the tubular bore from the seat that can simply be left in place or milled as well. An E4#10 from Baker Hughes is modified for adaptive seat delivery.

21 Claims, 19 Drawing Sheets

RUNNING TOOL FOR RECESS MOUNTED ADAPTIVE SEAT SUPPORT FOR AN ISOLATING OBJECT FOR BOREHOLE TREATMENT

CROSS REFERENCES TO RELATED APPLICATION

Priority of U.S. Provisional Patent Application Ser. No. 62/332,708, Filed May 6, 2016, incorporated herein by reference, is hereby claimed.

STATEMENTS AS TO THE RIGHTS TO THE INVENTION MADE UNDER FEDERALLY SPONSORED RESEARCH AND DEVELOPMENT

None

FIELD OF THE INVENTION

The field of the invention is a barrier support used in sequential formation treatment and more particularly barrier supports that are energized by intrinsic potential energy for fixation in a tubular string to receive an object for isolating already treated zones below that are originally fracked or zones below that have been re-fractured where the drift dimension of the support is large enough that removal of the support is not necessary.

BACKGROUND OF THE INVENTION

Currently conventional frac plugs have to be milled/cut out after a well is hydraulically fractured. This can be very costly and it also restricts the depth at which plugs can be used. Plugs themselves can be run out to very long distances; however, such plugs cannot be easily milled/cut out after being set because coil tubing or other drilling/milling means can only extend out so far in a horizontal well.

There is also an issue with the amount of water it takes to pump a plug in a horizontal or directional well to its destination.

Dissolvable plugs and balls are available, but conventional technology is not reliable. A portion of the balls/plugs dissolve, but often they don't completely dissolve and they end up causing a restriction in the wellbore. Operators are often required to go back into a well and run a mill/cleaning trip to remove debris left by such dissolving plugs. This negates the benefits of running the dissolvable plug in the first place.

The present invention ("Adaptive Seat") also referred to as adaptive seal, or plainly the seat comprises a simple sealing seat and plug assembly designed to replace a conventional frac plug. The present invention is designed so that it can be deployed into the inner bore of a liner system and support a dart, ball or other dropped object. Once the dart/ball/object lands on the seat, it seals off the portion of the wellbore below the seat and makes it possible for the zone above the seat to be hydraulically fractured. Typically, a composite plug made up of many parts is used to accomplish this task. By contrast, the adaptive seat which is a relative simple low cost item of unitary construction that can be used instead of the costly composite frac plug.

The adaptive seat can be deployed using a conventional wireline or pipe-conveyed setting tool. The setting tool can be easily retrofitted by removing certain parts from its lower end and replacing them with components that allow the seat to be deployed in a well. Once deployed, the adapter kit for the seat has a collet mechanism that holds the adaptive seat in place while a mandrel adapter pushes the seat into position. Once the seat is in position, an observable pressure increase is visible at surface to let an operator know the seat has been set within a wellbore.

The seat does not have any issues running downhole or in a horizontal well since it doesn't have any packer/rubber elements on it. As such, the bottom hole assembly for the seat can be run into a wellbore and set very quickly, up to two to three times faster than conventional frac plugs.

The seat design has a large internal diameter (ID), including after it is set in casing. The seat will not need to be milled out. The dart/ball/object is constructed of dissolvable material so it does not have to be milled out either.

In one embodiment, the adaptive seat is run in conjunction with a dart/ball that has a slight taper which will help the adaptive seat seat/set. The harder you pump on the dart the more it pushes the seat radially outward into the casing which insures said seat is fully set.

The seat is designed to handle high amounts of stress while it is coiled into a small adaptive seat and expand out into a recessed area when relaxed or against a support in a tubular passage. This can be done by optionally cutting the outside diameter and the inside diameter of a square or circular seat such that the high stresses in the outside diameter and inside diameter of the seat are removed and the seat is free to open out to its uncompressed size from very small diameters.

The dart/ball supports the seat in its groove and makes it impossible for the seat to come out of the groove. It can be designed with a taper which lands in the inside diameter of the seat and pushes the seat out into the groove. Additionally or alternatively, the seat can have a bevel or chamfer for the same purpose. The seat can have a seal on the front of it to help it seal against the seat so the seat doesn't have to be designed with a seal on it. Alternatively, the seat can seal using a metal-to-metal seal.

A conventional setting tool can be used to easily deploy the adaptive seat. It's designed with a collet assembly to hold the seat from getting cocked in the inside diameter of the casing. Once the setting tool pushes the seat down to a groove in the casing, a pressure increase will be observable at surface allowing the operator to stop operations and retrieve the setting tool.

The adaptive seat removes the need to run a costly composite frac plug. Having a single part greatly reduces cost and failure modes. It can be run out to any depth since it does not have to be milled up later.

The seat also has a very large inside diameter, even when it's set into a groove in a wellbore. This makes it possible to leave the seat in a well and not have to go back and mill it out.

A dart/ball is used in conjunction with the seat. The interface between the dart and the seat make the seat much less likely to collapse and not likely to come out of the groove. Having a taper on the dart or seat also allows the dart to apply additional forces on the seat such that it will aid the seat in staying in the groove under high pressures typically observed during a hydraulic fracturing operations.

Modifying the outside diameter and the inside diameter of the seat with small gaps or cuts, it is possible to decrease the stresses in the seat and make it possible to "roll" up the seat into a small cylinder and then knock it out of its cylinder so that it opens up radially outward. This makes it possible to land said seat into a groove in the inner surface of the wellbore. It sticks out in the inside diameter just enough to catch the dart/ball and its inside diameter is large enough that small diameter composite plugs can be run through it if needed. A composite plug can still be used as a contingency if there's an issue with the seat or the casing. The large inside also leads to composite plugs being run through it for re-fracs later in the well's life.

The seat of the present invention is a single item, very cost effective, and simple to deploy, there is no need to go back and mill/cut up a plug. Frac plugs can be run through it if needed. Those skilled in the art will more readily appreciate these and other aspects of the present invention from a review of the description of the preferred embodiments and the associated drawings while appreciating that the full scope of the invention is to be determined from the appended claims.

SUMMARY OF THE INVENTION

The adaptive seat is held to a smaller diameter for delivery with a tool that can feature a locating lug for desired alignment of the seat with an intended groove in the inner wall of a tubular. The release tool retracts a cover from the seat allowing its diameter to increase as it enters a groove. Alternatively the seat can be released near the groove and pushed axially in the seat to the groove for fixation. Once in the groove the inside diameter of the string is a support for a blocking object so that sequential treatment of parts of a zone can be accomplished. The blocking object can be removed with pressure, dissolving or disintegration leaving a narrow ledge in the tubular bore from the seat that can simply be left in place. A known setting tool such as an E4#10 from Baker Hughes is modified for seat delivery.

BRIEF DESCRIPTION OF THE DRAWINGS

FIG. 4 is a schematic view of the adaptive seat retained by a sleeve for running in;

FIG. 24 is another version of the seat running tool during running in;

DETAILED DESCRIPTION OF THE PREFERRED EMBODIMENT

Figure 1:
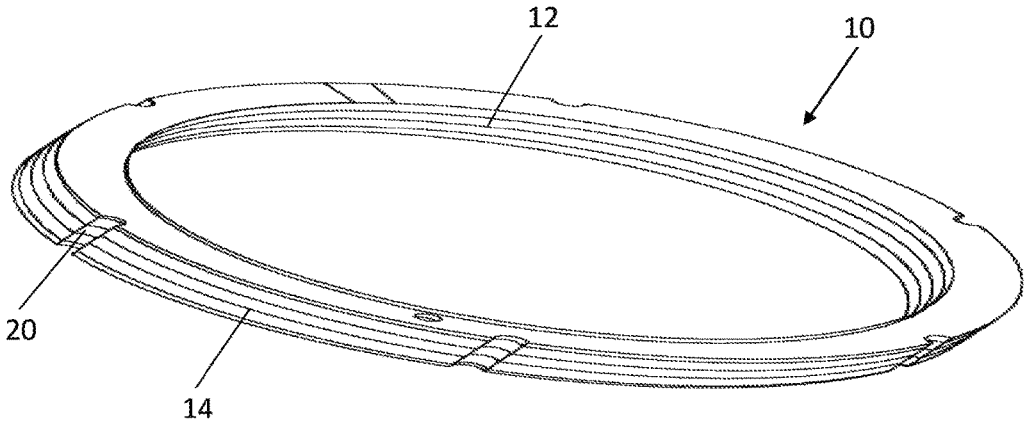
FIG. 1 is a perspective view of the adaptive seat showing outer surface notches.
Figure 2:
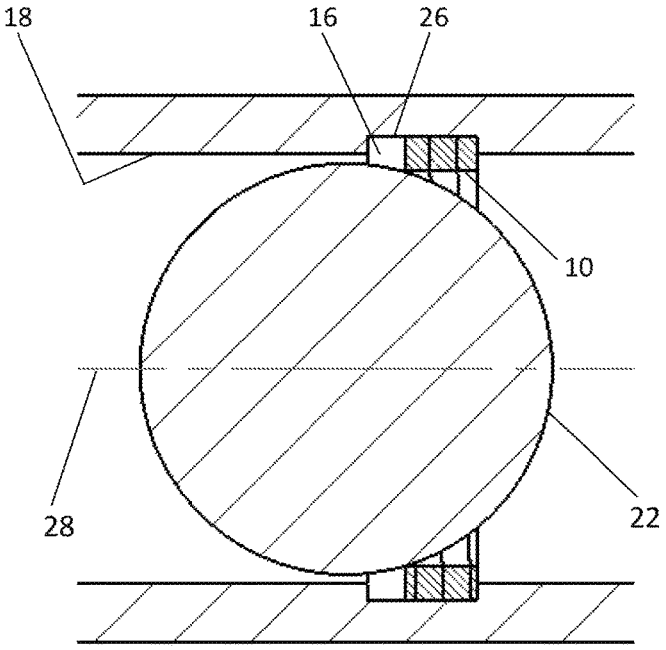
FIG. 2 is a section view of the adaptive seat in its tubular notch with a ball landed.
Figure 3:
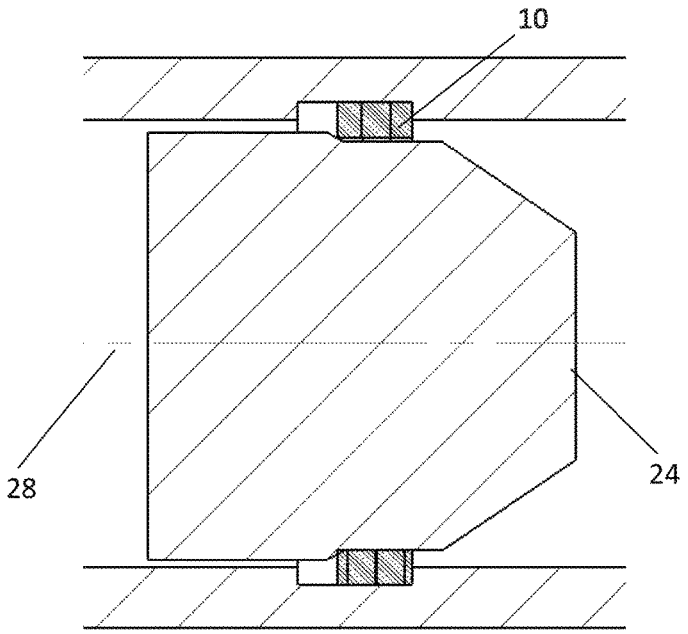
FIG. 3 is the view of FIG. 2 with a dart landed.
Figure 4:
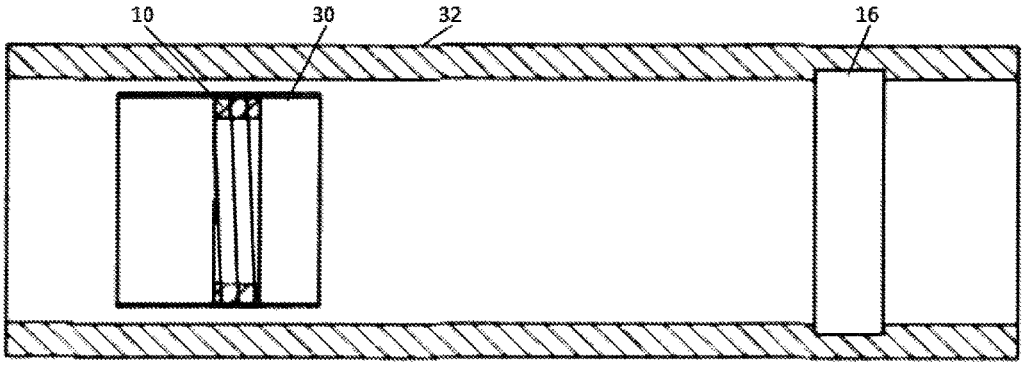

Referring to FIG. 1 a round shaped adaptive seat 10 is illustrated. It is preferably a continuous coil of preferably flat material that presents an inner surface 12 and an outer surface 14. Preferably surfaces 12 and 14 are aligned for each winding when the adaptive seat 10 is allowed to relax in a retaining groove or recess 16 located in a tubular such as casing or liner or sub 18. Alternatively the outer surface 14 can have surface treatment or texture to bite into or penetrate into the tubular wall when allowed to relax into contact with the tubular wall for support of an object such as ball 22 or dart 24 by resisting shear stress transmitted to adaptive seat 10. Since the seat 10 is delivered compressed to a smaller diameter there can optionally be notches 20 in outer surface 14 to reduce the force needed to reduce the diameter of the seat 10 for running in. Notches 20 also reduce the stress in the adaptive seat. Optionally notches such as 20 can also be on inside surface 12, however locating them there may also create a fluid path for some leakage when a ball 22 or a dart 24 land on the seat 10 as shown in FIGS. 2 and 3. Alternatively, surface 12 can have a taper, bevel or chamfer to help the ball 22 or the dart 24 seal against the seat 10. On the other hand, the ball 22 or dart 24 or some other blocking shape can also block any notches that may be located on the inner surface 12. Preferably all the coils of seat 10 hit bottom surface 26 of groove 16 at the same time so that on release or movement into groove 16 the outer surface 14 and the inner surface 12 form a cylindrical shape. As shown in FIGS. 2 and 3 the extension of adaptive seat 10 into the flowpath having a centerline 28 is only to the extent to withstand the anticipated shear loading on the seat 10 when treatment pressure is applied from above to seated ball 22 or dart 24 or some other blocking object. Ball 22 or dart 24 or some other blocking object are designed to be removable from adaptive seats 10 after the desired increments of a zone to be treated are completed. Removal of ball 22 or dart 24 or some other equivalent blocking object can be with applied pressure to a predetermined value higher than the anticipated treating pressures. Alternatively, materials can be introduced into the borehole that can dissolve the ball 22 or dart 24 or equivalent blocking object by exposure to well fluid. Materials can be selected that will disintegrate with time exposure to well fluids such as controlled electrolytic materials that are known or that change shape with thermal exposure to well fluid so that they can pass through an inside diameter of inner surface 12 of the seat 10 in the deployed positions of FIGS. 2 and 3. After that happens there is no need to mill out because the extension of the seat 10 into the passage denoted by centerline 28 is sufficiently minimal that negligible resistance to subsequent production flow is offered by the seat 10 located throughout the treated interval. Optionally, if the material of the seat 10 can tolerate compression to a run in diameter and still exhibit a property of dissolving or disintegration or can otherwise be non-interventionally removed then not only ball 22 and dart 24 or their equivalent blocking member be removed non-interventionally, but also the seat 10 can also be removed leaving open grooves 16 that will have even less impact on subsequent production flow rates after the treatment is over and production begins. Seat 10 can be circular with an adjustable diameter without permanently deforming.

While the preferred treatment is fracturing, the teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc., all collectively included in a term "treating" as used herein. Another operation can be production from said zone or injection into said zone.

Referring to FIGS. 4-7, adaptive seat 10 is shown retained by a retaining sleeve 30 on the way to a groove 16. Although a single adaptive seat 10 and a single groove 16 are shown the invention contemplates delivery of multiple adaptive seats 10 in a single trip to multiple grooves 16 that are spaced apart. Alternatively, each section of tubular 32 that is manufactured with a groove such as 16 can already have an adaptive seat 10 inserted into a respective groove 16 at the tubular fabrication facility or at another facility or at the well site before a string is made up with stands of tubulars such as 32. Preassembling the seats 10 into respective grooves 16 before the pipe 32 is assembled into a string and run in saves rig time otherwise used to deliver the seats 10 after the string is already in the hole. The downside is that different inside diameters would need to be used so that sequentially larger objects would need to land on successive adaptive seats such that the seats with the smallest opening would then be candidates for removal. Another disadvantage is that the blocking objects would have to be delivered sequentially by size and that can introduce operator error. By inserting the seats one at a time the same large inside diameter opening can be used so that all the balls or objects are the same size and the seat opening diameter in the deployed state is large enough so that removal of the seat after treatment is not necessary.

Figure 5:
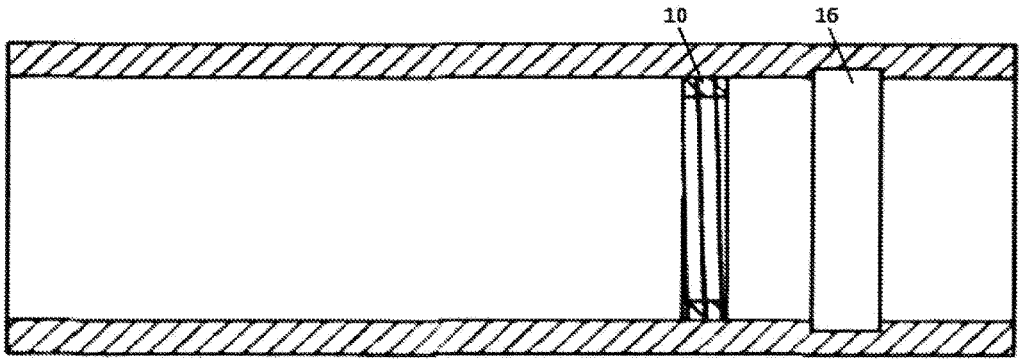
FIG. 5 is the view of FIG. 4 with the adaptive seat landed adjacent its intended support groove.
Figure 6:
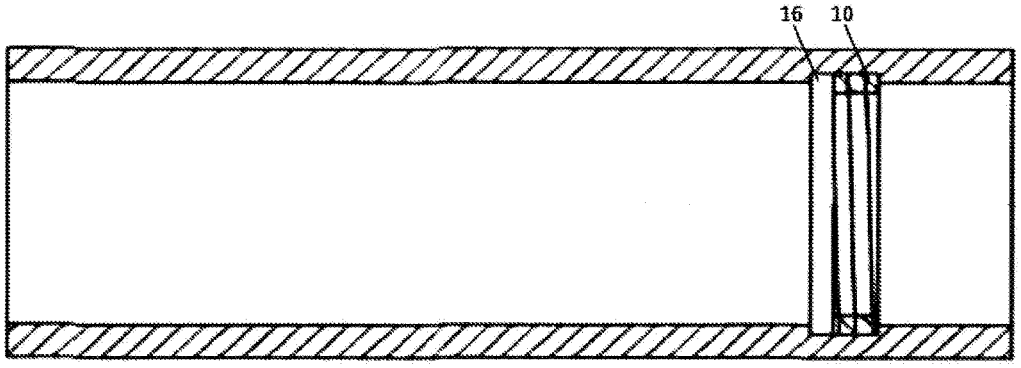
FIG. 6 is a schematic view of the adaptive seat landed or pushed into its intended support groove.
Figure 7:
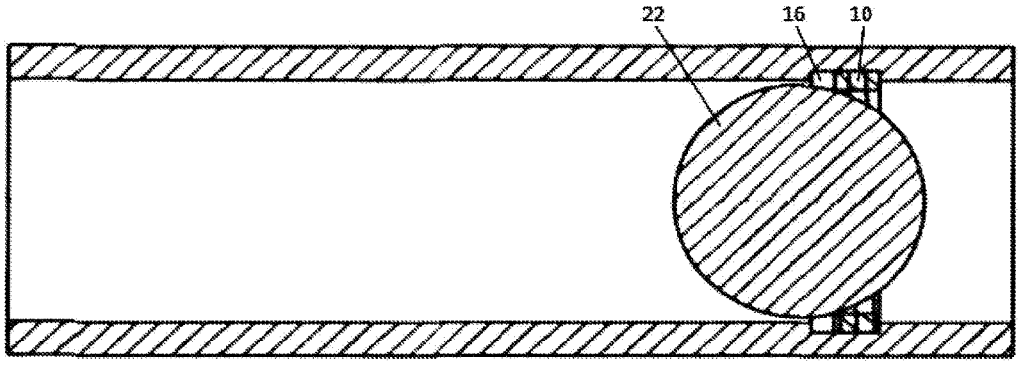
FIG. 7 is the view of FIG. 6 with a ball landed on the adaptive seat.

FIG. 5 shows deploying at least one adaptive seat 10 adjacent grooves 16 which would then require pushing the seat in its quasi relaxed state axially until it snaps into groove 16 as it further relaxes. Alternatively, the seat 10 can be released when aligned with a respective groove 16 such as by using a locating tool as will be described below so that when allowed to relax the seat 10 will go directly into the groove 16 without the need to be pushed axially. FIG. 7 shows a ball 22 somewhat distorted by differential pressure during a treatment while seated on seat 10 when seat 10 is supported in groove 16.

Figure 8:
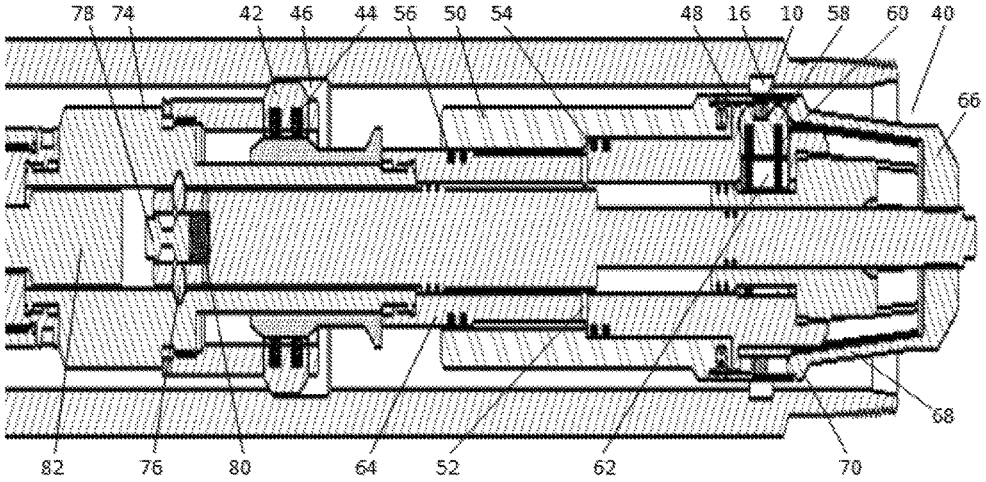
FIG. 8 is a section view of a run in position for a first version of a adaptive seat delivery tool.
Figure 9:
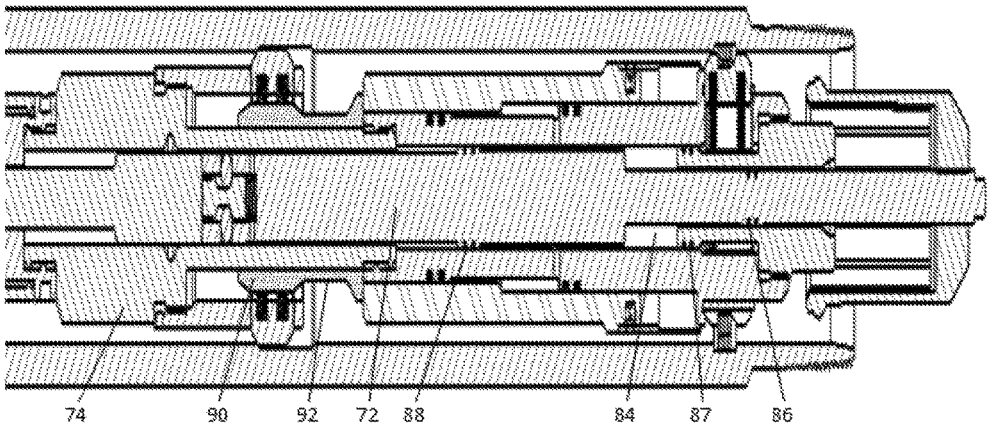
FIG. 9 is the view of FIG. 8 in the seat released position.
Figure 10:
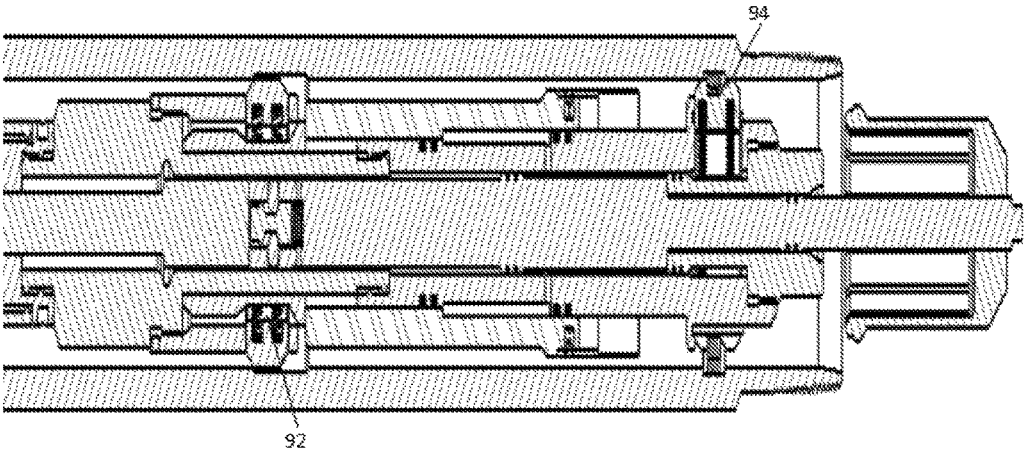
FIG. 10 is the view of FIG. 9 with the tool released from a locating groove for removal.
Figure 11:
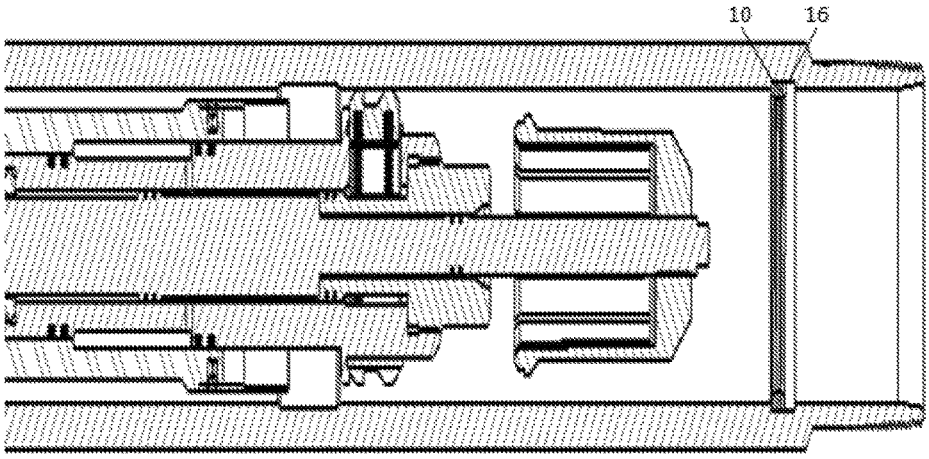
FIG. 11 is the view of FIG. 10 as the delivery tool is pulled out of the hole.
Figure 12:
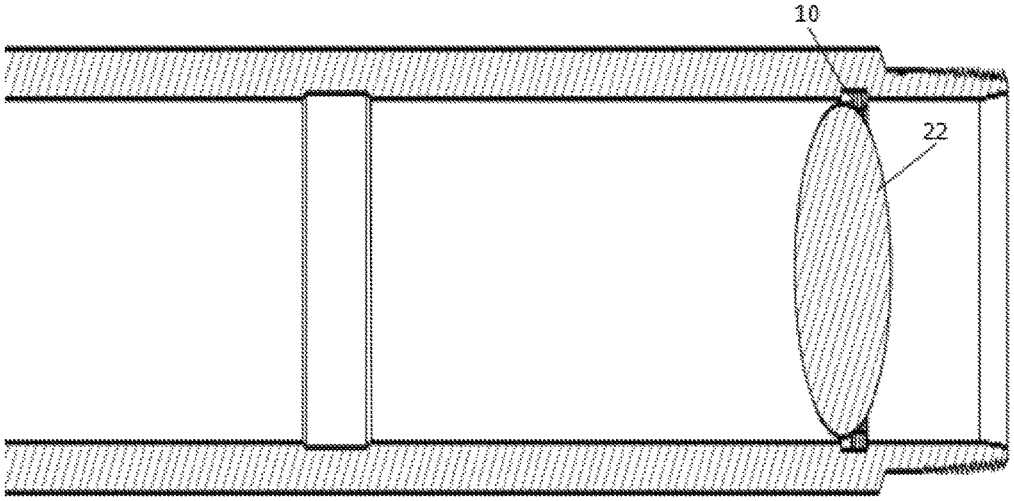
FIG. 12 is the view of FIG. 11 with an object laded on the seat when the seat is extended into a groove.

FIGS. 8-12 illustrate a preferred design for a delivery tool 40 to deliver an adaptive seat 10 to a groove 16. One or more dogs 42 are radially outwardly biased by springs 44 into a locating groove 46 as shown in FIG. 8. A pickup force places the dogs 42 at the top of locating groove 46 and aligns the seat 10 in a compressed state due to a cover sleeve 48 with groove 16. Piston 50 moves from pressure applied through passage 52 into a variable volume between seals 54 and 56. Movement of piston 50 takes with it sleeve 48 so that the seat 10 is exposed to radially relax as seen in FIG. 9 for placement in groove 16. Segmented retainers 58 are radially biased by springs 60 so that when sleeve 48 is retracted by outer piston 50 the movement of the retainer segments 58 is guided radially by opening 62 in lower mandrel 64. Lower cap 66 has a series of collet fingers 68 that terminate in heads 70 to protect the sleeve 48 and the seat 10 from damage during running in. Inner piston 72 is initially locked against axial movement to upper mandrel 74 by virtue of one or more lugs 76 supported into upper mandrel 74 by an hourglass shaped support member 78 biased to be in the FIG. 8 position by a spring 80. Plunger 82 can be part of a known setting tool such as an E4#10 explosively operated setting tool sold by Baker Hughes Incorporated of Houston, Tex. or other tools that can apply a mechanical force to support member 78 to allow lugs 76 to retract into the hourglass shape as shown in FIG. 9 can be used as an alternative. The movement of support member 78 can be locked in after allowing lugs 76 to retract to prevent subsequent re-engagement shown in the FIG. 8 position. Piston 72 in FIG. 9 is freed to move and is no longer locked to the upper mandrel 74 as a result of impact from plunger or actuating piston 82 of the known setting tool that moves piston 72. Movement of piston 72 reduces the volume of chamber 84 between seals 88, 87 and 86 that results in pressure buildup through passage 52 and stroking of the piston 50 to retract the sleeve 48 from over the seat 10 to deliver the seat 10 into groove 16 in the manner described above, as shown in FIG. 9. Thereafter the removal of the tool 40 is accomplished with picking up upper mandrel 74 that takes with it release sleeve 90 and presents recess 92 under lugs 42 so that lugs 42 can retract from groove 46, as shown in FIG. 10. Segmented retainers 58 have a sloping surface 94 that allows an uphole force to retract them as they jump over the seat 10 now supported in groove 16 with the potential energy releases from the seat 10 by retraction of the sleeve 48. FIG. 11 shows the entire delivery assembly of tool 40 coming away from seat 10 that remains in groove 16. FIG. 11 shows a ball 22 delivered to the seat 10 and pressure applied from above during a treatment such as a frac when the region above has previously been perforated.

Figure 13:
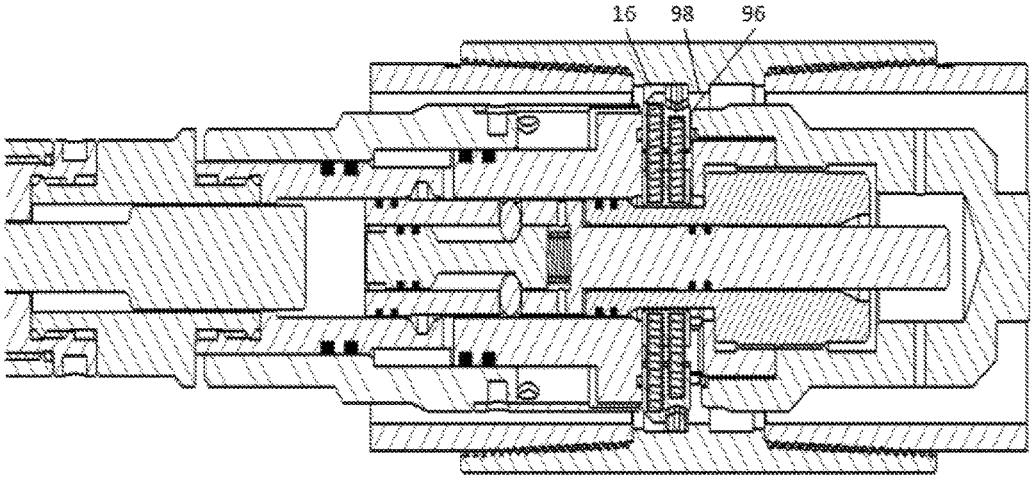
FIG. 13 is another version of the seat delivery tool in the running in position.
Figure 14:
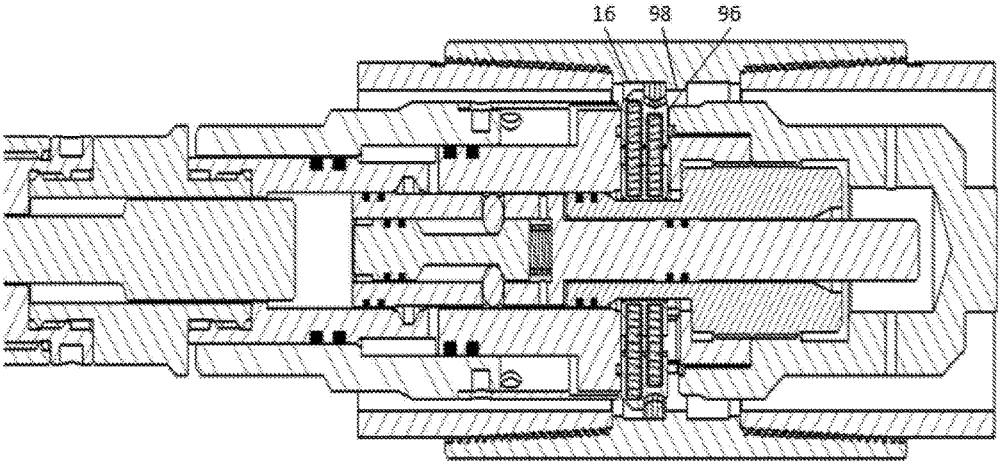
FIG. 14 is the view of FIG. 13 with the seat set in a groove.

FIGS. 13 and 14 are essentially the same design as FIGS. 8-12 with the difference being that the locating lugs 42 are omitted and the outer shape of support segments 58 is such that the compressed adaptive seat 10 is supported near lower end 96 so that if released above groove 16 the seat 10 can be pushed down axially into groove 16 to further move out. Another groove 16' is provided in the event the segments 58 are installed in the reverse orientation than that shown so that the seat 10 can be released below groove 16' and pulled up into it. If groove 16' were not there and the segments 58 were installed in a reverse orientation than shown the seat 10 would not be movable uphole beyond reduced diameter 98.

Figure 15:
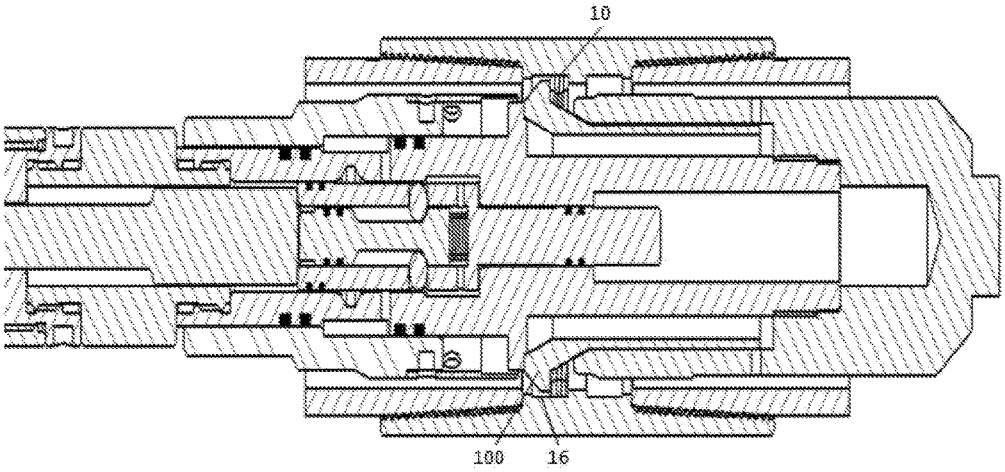
FIG. 15 is another version of the seat delivery tool with the seat released into an associated groove.

FIG. 15 works similarly to FIG. 13 except that an array of collet fingers 100 can engage the seat 10 released above groove 16 and push it down into extension into groove 16 as shown.

Figure 16:
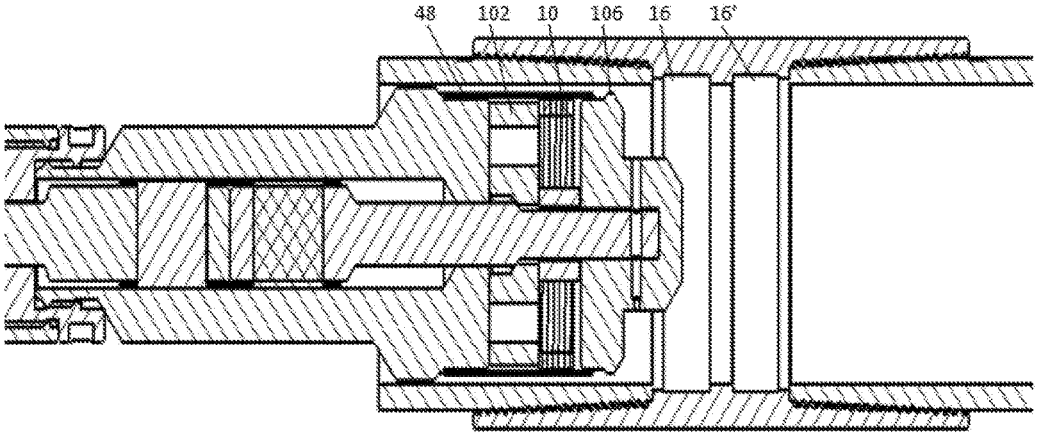
FIG. 16 is another version of the seat delivery tool in the seat running in position.
Figure 17:
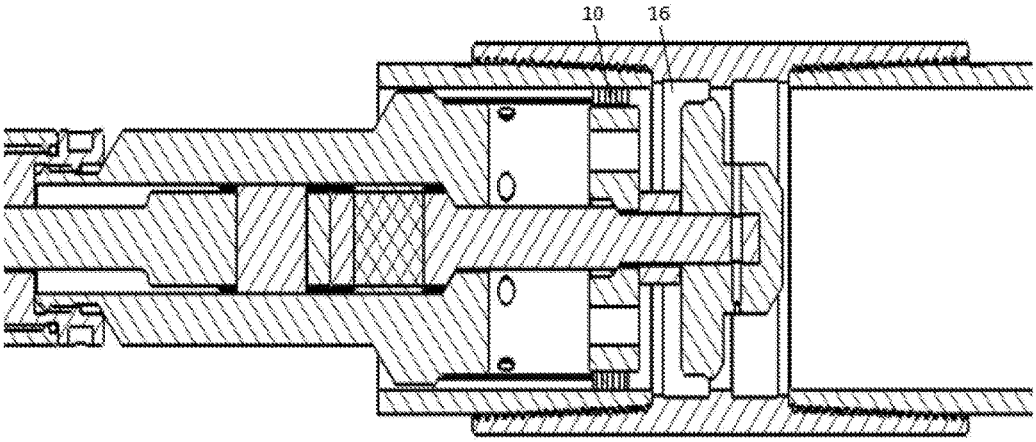
FIG. 17 is the view of FIG. 16 in the seat pre-set position.
Figure 18:
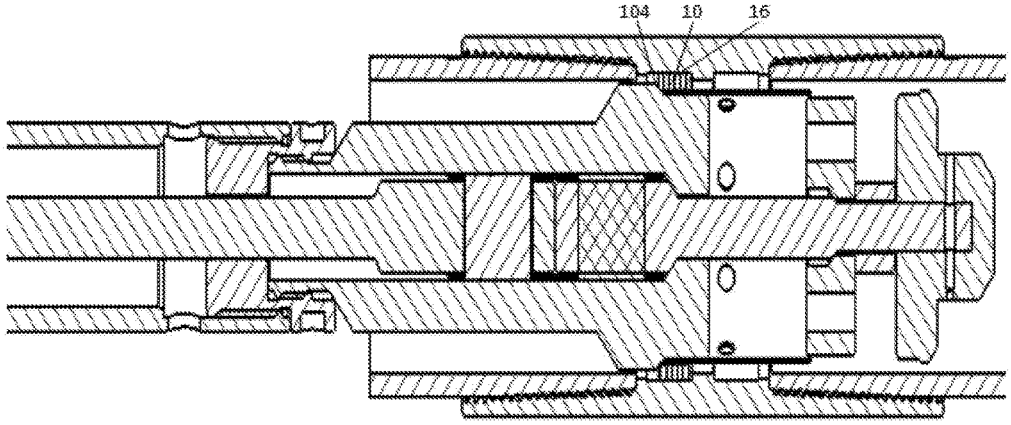
FIG. 18 is the view of FIG. 17 in the seat set position.

FIGS. 16, 17 and 18 use a movable hub 102 to push the adaptive seat 10 axially out from under sleeve 48 which in the design shown should release the seat uphole or to the left of groove 16 so that tapered surface 104 can push the seat 10 in a downhole direction or to the right into groove 16. Alternatively if the seat is actually released downhole or to the right of groove 16' then tapered surface 106 can be used to move the seat 10 uphole or to the left into groove 16'.

Figure 19:
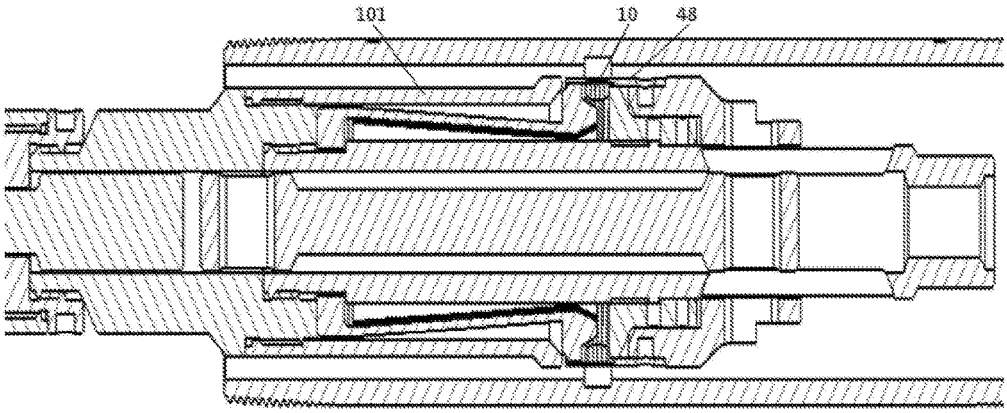
FIG. 19 is another version of the seat delivery tool in the running in position.
Figure 20:
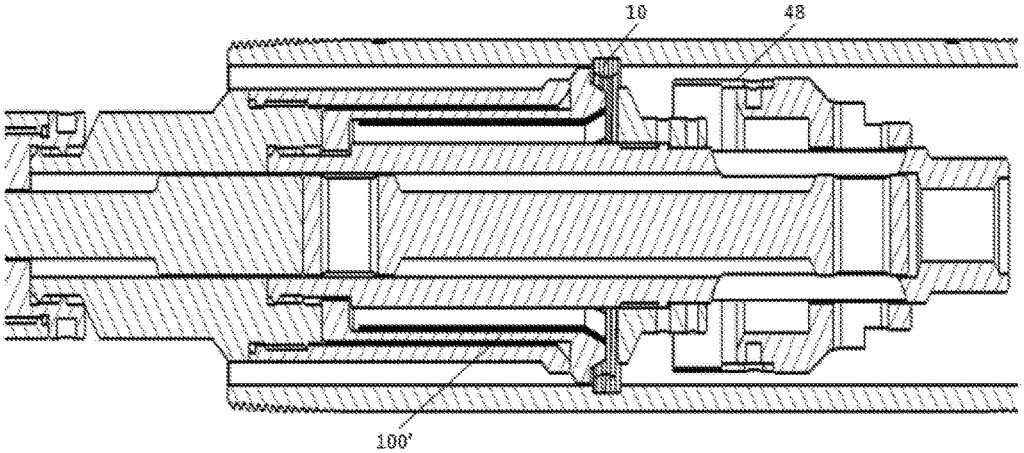
FIG. 20 is the view of FIG. 19 in the seat set position.

In FIGS. 19 and 20 the cover sleeve 48 is pushed downhole away from the seat 10 and collets 100' either guide the seat into groove 16 or push seat 10 downhole into groove 16 if seat 10 is released above groove 16.

Figure 21:
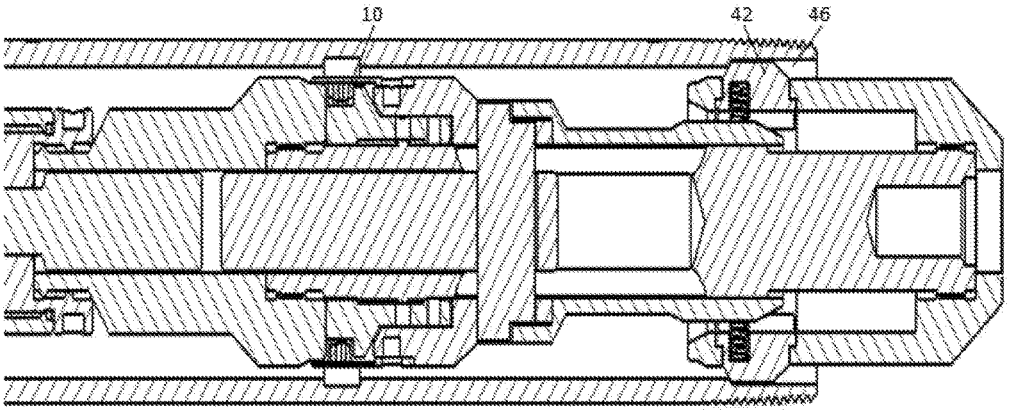
FIG. 21 is another version of the seat running tool in the run in position.
Figure 22:
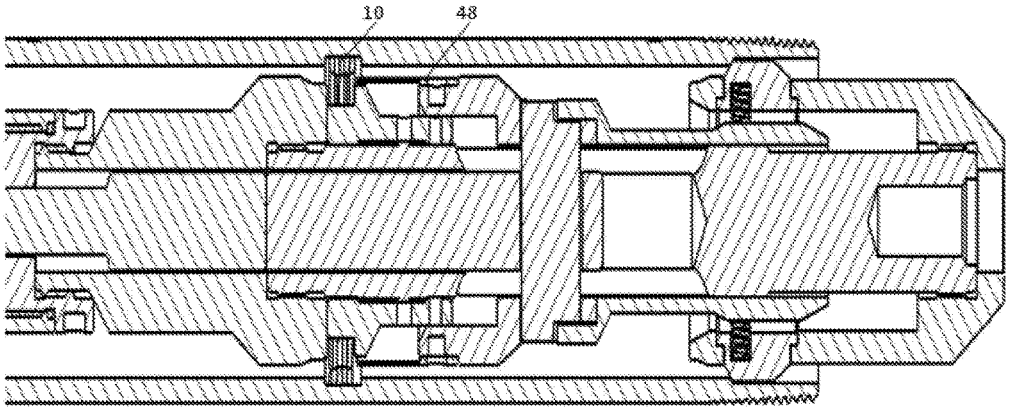
FIG. 22 is the view of FIG. 21 is the seat set position.
Figure 23:
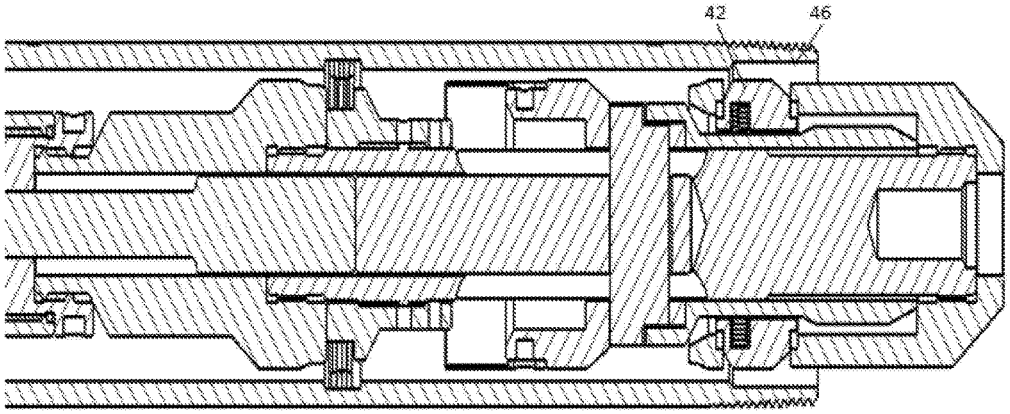
FIG. 23 is the view of FIG. 22 with the tool being removed from the hole.
Figure 24:
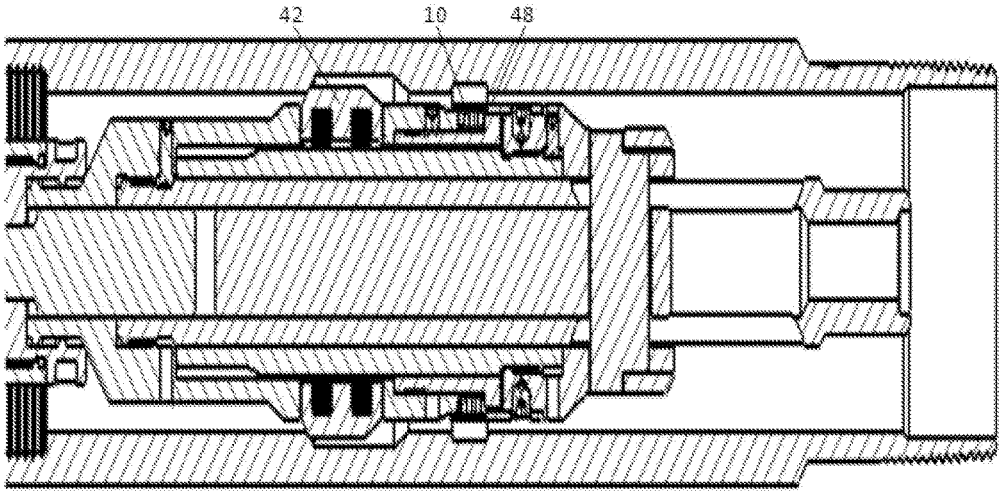
Figure 25:
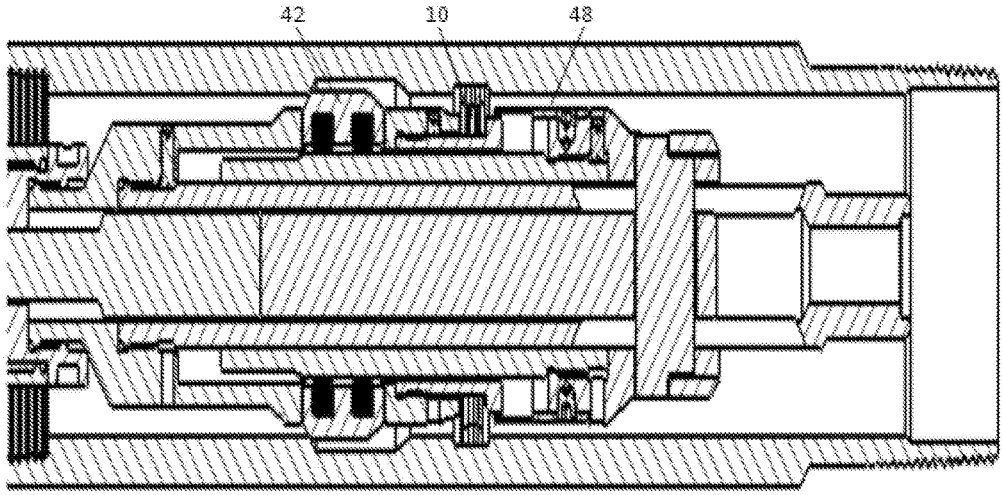
FIG. 25 is the view of FIG. 24 with the seat set.
Figure 26:
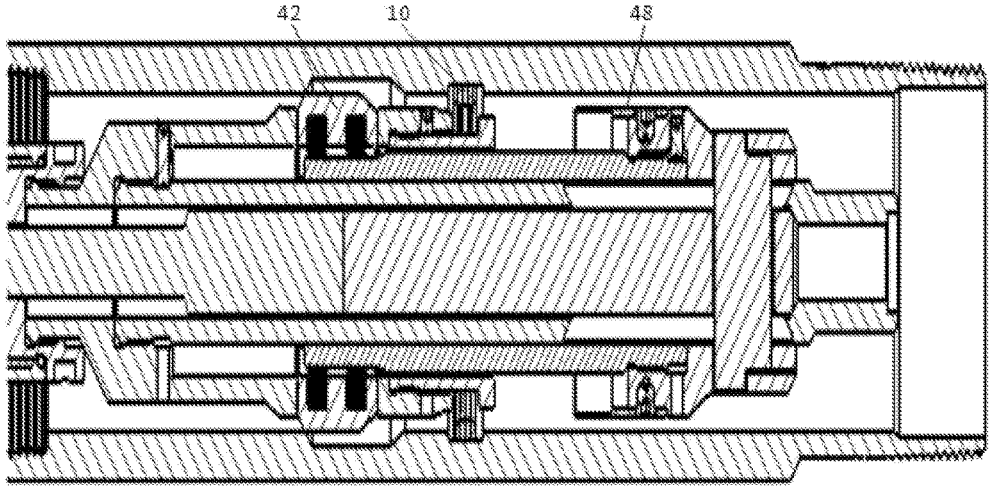
FIG. 26 is the view of FIG. 25 with the tool released for removal.
Figure 27:
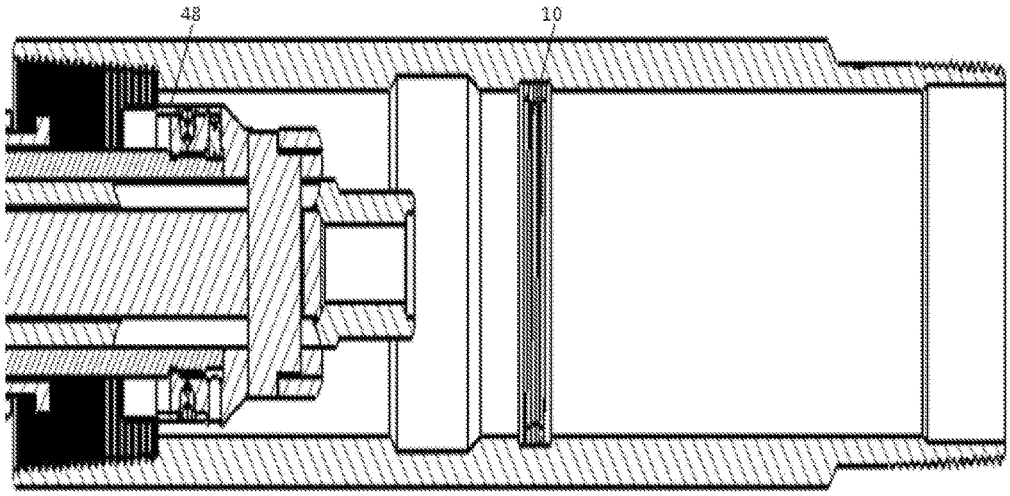
FIG. 27 is the view of FIG. 26 showing the tool being removed.

FIGS. 21-23 are similar to FIGS. 8-12 except that the locating lugs 42 a below seat 10 when entering groove 46 and the locking feature such as 78 is not used.

FIGS. 24-27 are similar to FIGS. 8-12 with the locking feature 78 eliminated and the sleeve 48 moved out from over the seat 10 in a downhole direction as opposed to an uphole direction in FIGS. 8-12.

Figure 28:
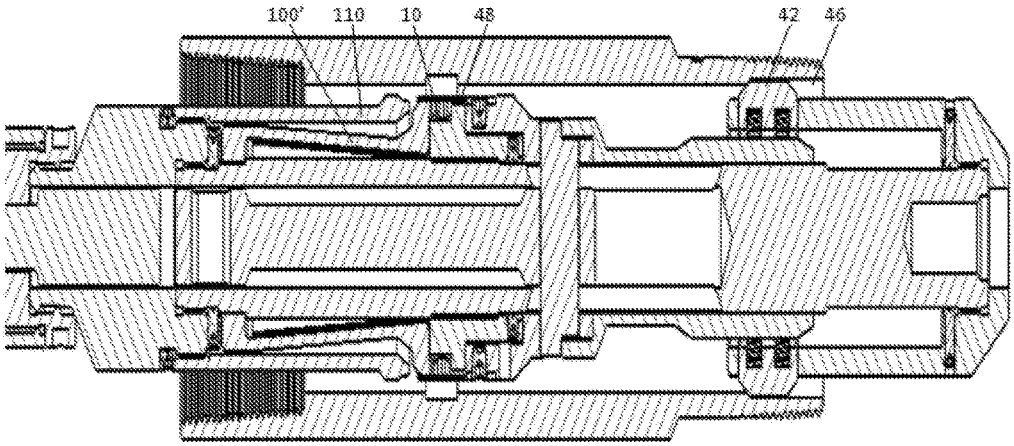
FIG. 28 is another version of the tool in the running in position.
Figure 29:
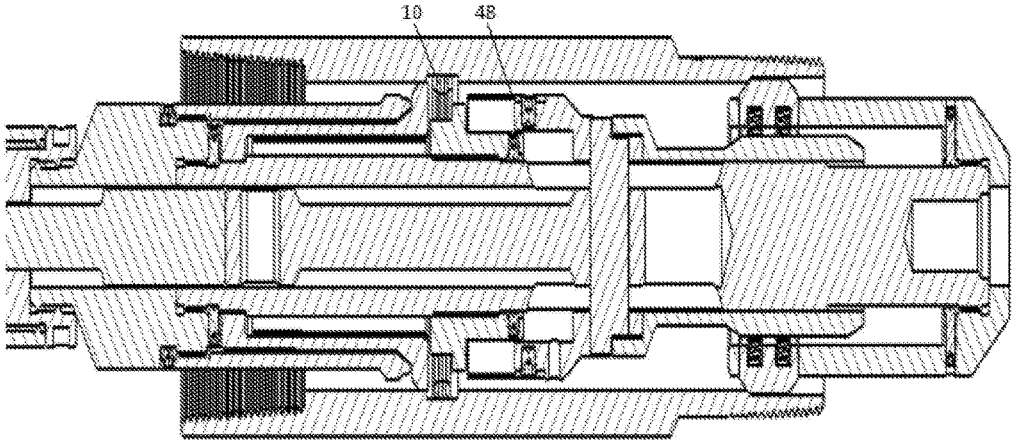
FIG. 29 is the view of FIG. 28 in the seat set position.
Figure 30:
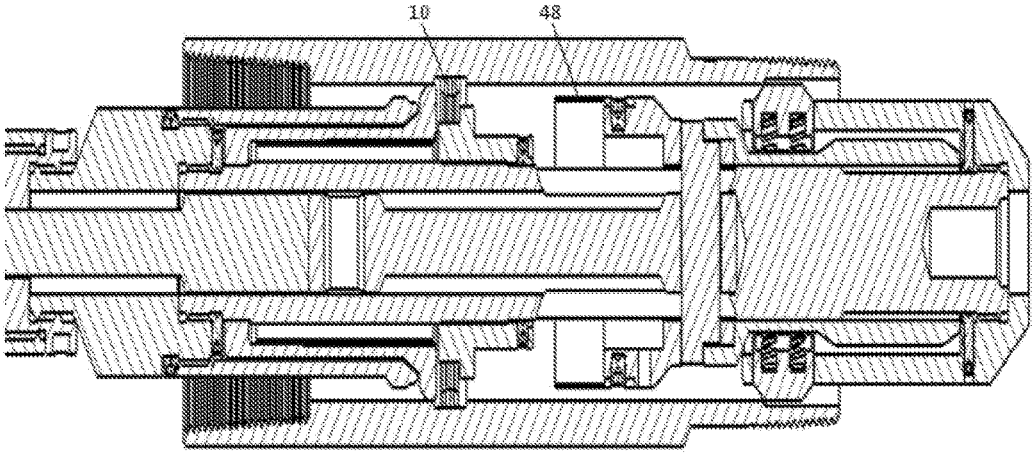
FIG. 30 is the view of FIG. 29 with the tool released for removal.
Figure 31:
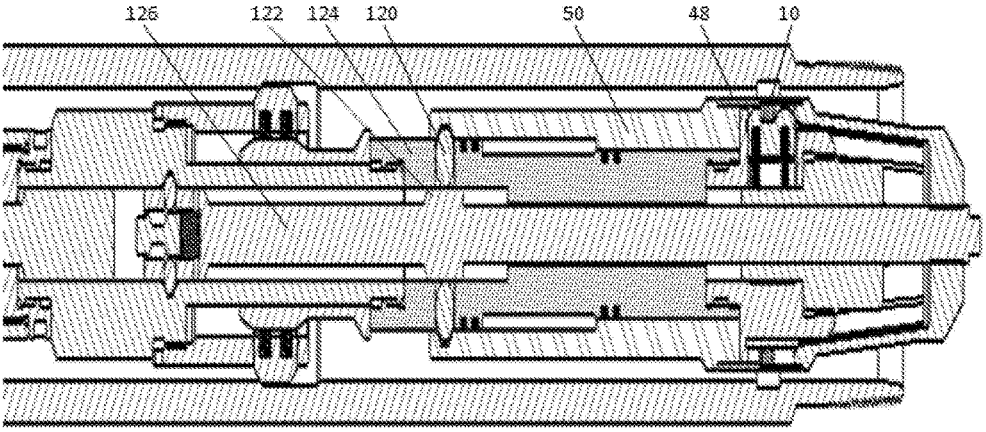
FIG. 31 is another version of the seat delivery tool in the running in position.
Figure 32:
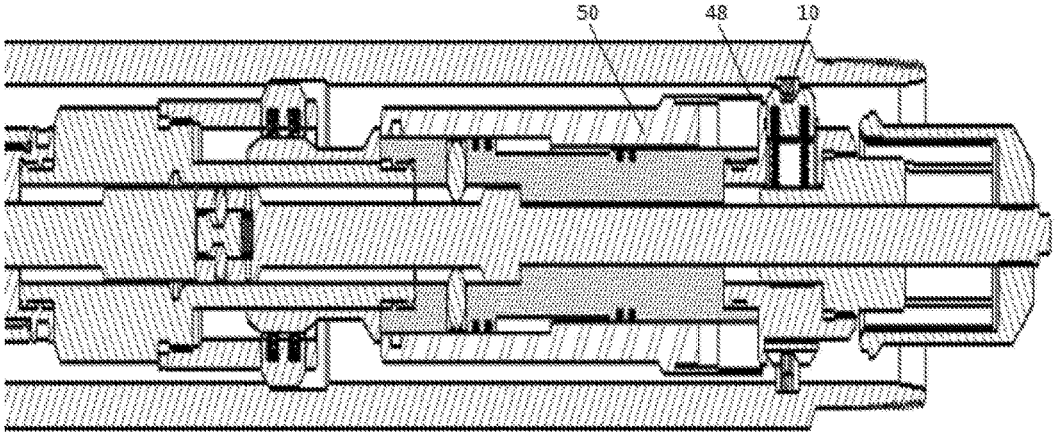
FIG. 32 is the view of FIG. 31 in the seat released position.
Figure 33:
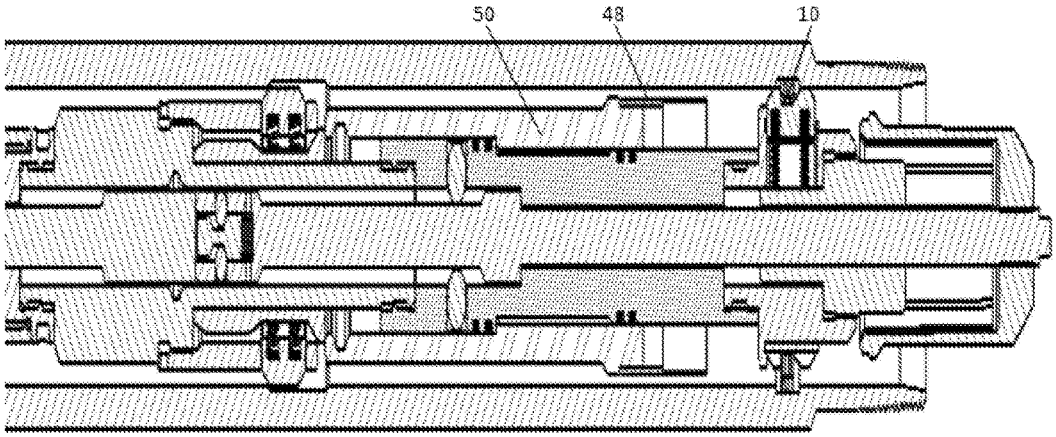
FIG. 33 is the view of FIG. 32 with the tool released from a locating groove for removal.
Figure 34:
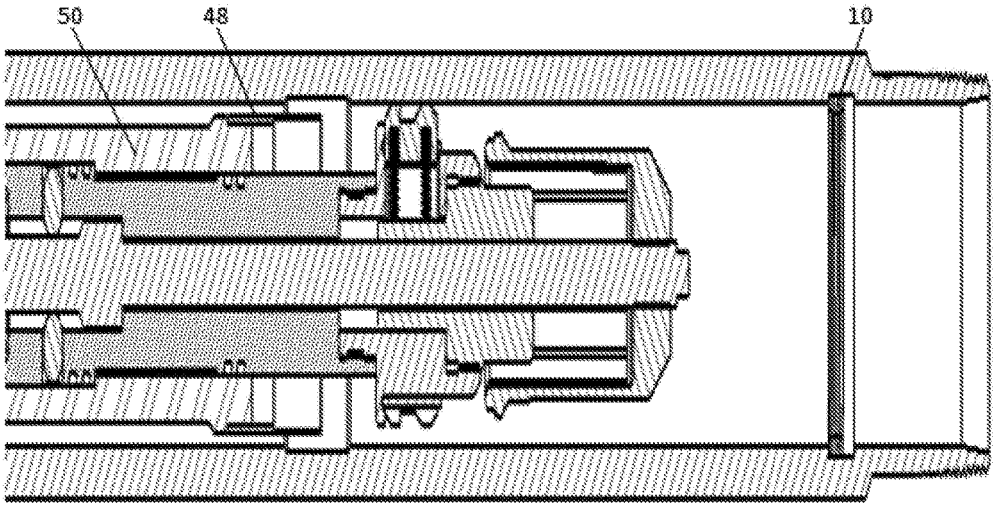
FIG. 34 is the view of FIG. 33 as the delivery tool is pulled out of the hole.
Figure 35:
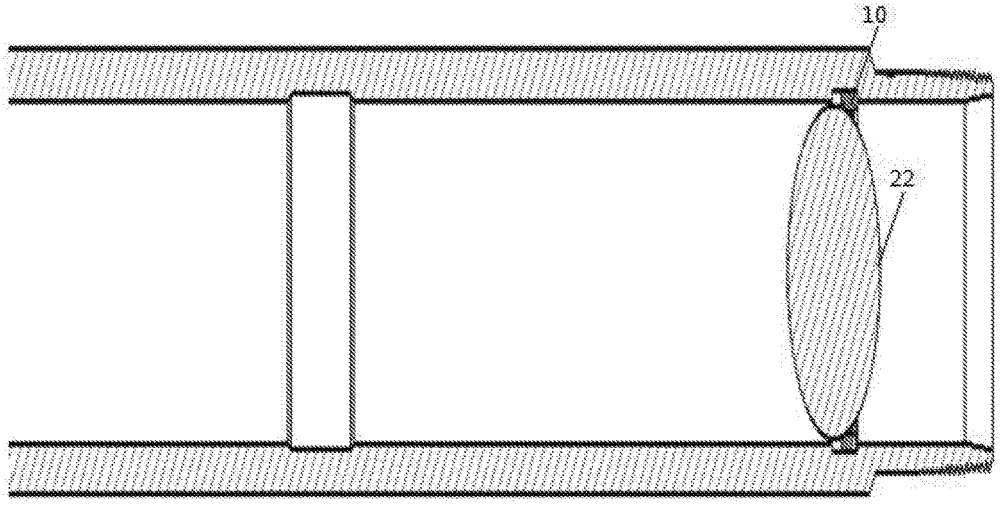
FIG. 35 is the view of FIG. 34 with an object landed on the seat when the seat is extended into a groove.

FIGS. 28-30 are similar to 21-23 with respect to the use and location of the locating dogs 42 and retaining sleeve 48 pulled in a downhole direction but also incorporating the nested collets 100' and protective sleeve 110 shown in FIGS. 18-19 for the same purpose of protecting the sleeve 48 for running in as in the case of protective sleeve 110 and to guide the seat 10 into groove 16 whether the seat 10 is initially aligned with groove 16 as it should be in FIGS. 28-30 in a groove since there are dogs 42 in locating groove 46.

FIGS. 31-35 are similar to FIGS. 8-12 except that the outer piston 50 is moved with hydrostatic pressure instead of pressure applied through a passage. Hydrostatic pressure is the pressure generated by the column of fluid in the well bore. Outer piston 50 is initially locked against axial movement to lower mandrel 124 by virtue of one or more lugs 120 supported into outer piston 50 by a protrusion shaped support member 122 on mandrel 126. Once the protrusion shaped support member 122 is moved the lugs 120 are allowed to retract and allow movement.

Figure 36:
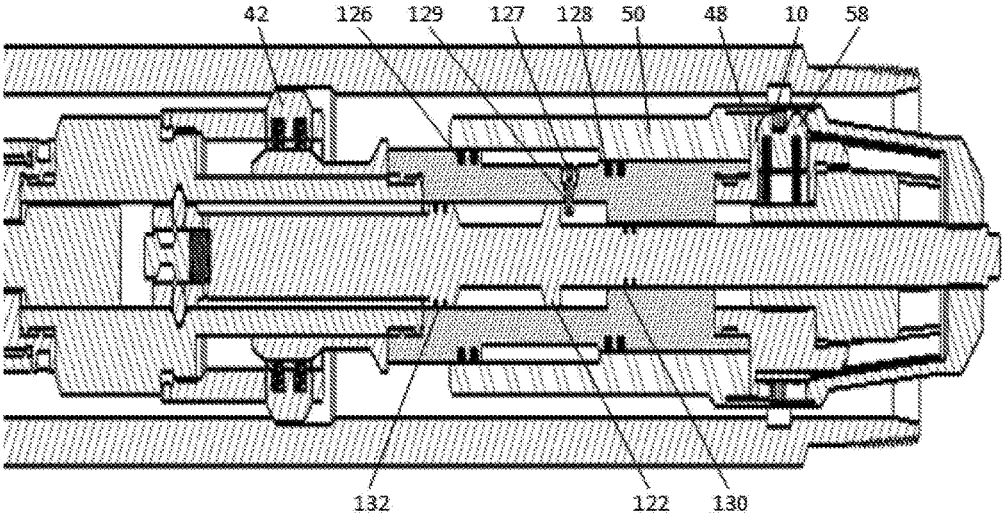
FIG. 36 is another version of the seat delivery tool in the running in position.
Figure 37:
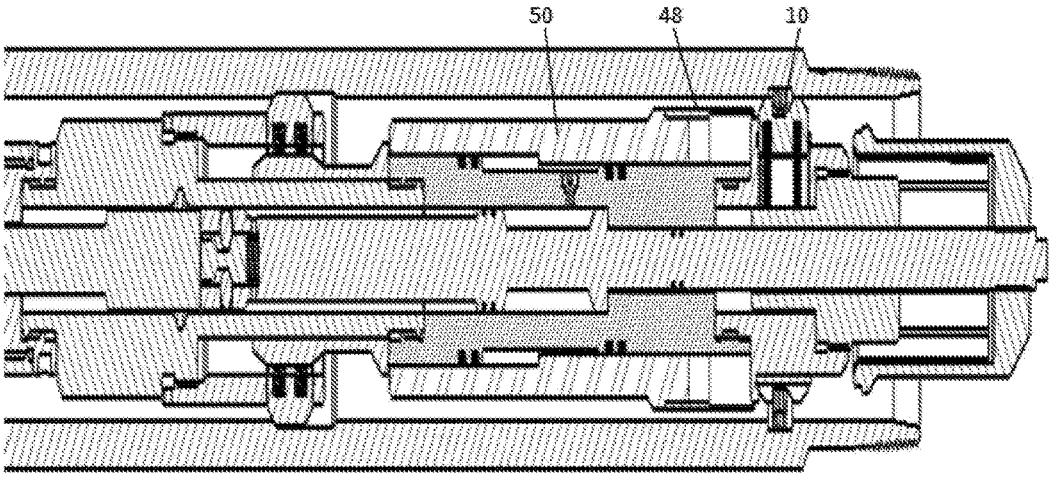
FIG. 37 is the view of FIG. 36 in the seat released position.
Figure 38:
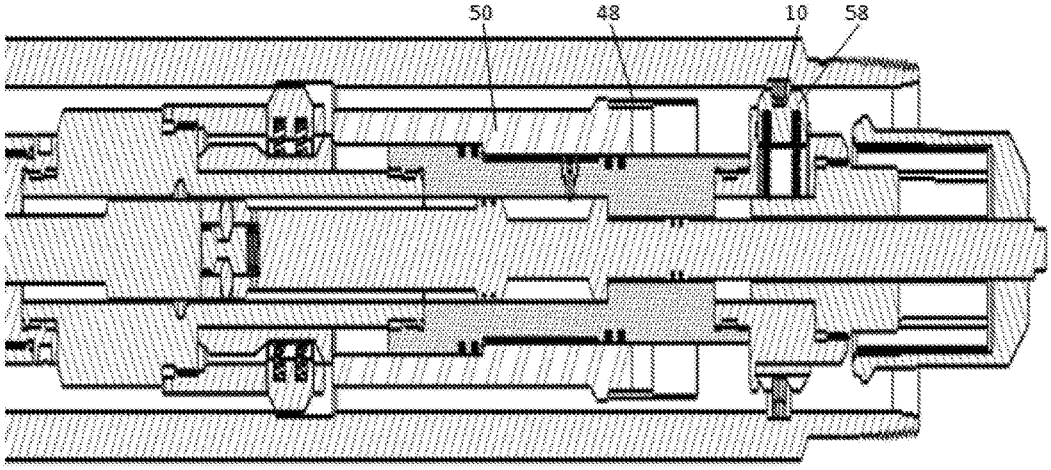
FIG. 38 is the view of FIG. 37 with the tool released from a locating groove for removal.

FIGS. 36-38 are similar to FIGS. 31-35 except that the outer piston 50 is locked in place with hydraulic fluid which is trapped between seals 126 and 128. The shear bolt 127 is partially drilled to leave a passage 129 for fluid to flow through once the protrusion shaped support member 122 is forced to shear the bolt and leave unrestricted flow of passage 129 into the inner volume created by seals 130 and 132.

Those skilled in the art will now appreciate the various aspects of the present invention. An adaptive seat is released into a predetermined groove and has minimal extension into the inside diameter, which preferably reduces the drift diameter of the passage therethrough by less than 10%, into the flow bore that is still sufficient to support a blocking object under pressure differential that is applied during a treatment. The adaptive seats are added one at a time as the next interval is perforated and then treated. The same size object is usable at each stage. There is no need to remove the seats after the treatment and before production as the reduction in drift dimension from the seats is minimal. The seat has preferably a rectangular, round or multilateral cross-section and may contain a chamfer or a bevel. The objects on the spaced adaptive seats can be removed with pressure, dissolving or disintegrating or with thermally induced shape change such as when using a shape memory material. Alternatively, milling can be used to remove the objects. Alternatively an induced shape change from thermal effects on the relaxed adaptive seat can reconfigure such a seat to retract within its associated groove to the point where there is no reduction of drift diameter from the seats in their respective grooves. Subsequent procedures can take place with equipment still being able to pass through an adaptive seat in its respective groove. If need be known frack plugs can be run in through a given adaptive seat and set in a known manner. The seat can have chamfers or slots on an inside or/and outside face to reduce the amount of force needed to compress the seat into a run in configuration. An alternative that is also envisioned is use of a ring shape of a shape memory material that needs no pre-compressing but grows into an associated groove with either added heat locally to take the seat above its critical temperature or using well fluids for the same effect to position such an adaptive seat of a shape memory alloy in a respective groove. The seats can be added sequentially after an already treated interval needs isolation. All the blocking objects can be removed after the zone is treated without well intervention as described above.

The delivery device can employ a locating dog so that when a cover sleeve and the compressed adaptive seat separate, the seat can relax into a groove with which it is already aligned. Alternatively the seat can be released near the groove and pushed axially into position in the groove. Some embodiments forgo the locating groove and associated dog. A known setting tool can be modified to provide motive force to a central piston whose movement builds pressure to move another piston that retracts a sleeve from over the seat. The central piston can be initially locked to prevent premature adaptive seat release. Actuation of the known setting tool modified for this application will first release a lock on the central piston and then move that piston to generate fluid pressure to retract the retaining sleeve from over the seat to place the seat in a respective groove. Alternatively an outer hydrostatic chamber is activated to move a piston and an outer sleeve to uncover the adaptive seat. The retaining sleeves' piston can be held in place by lugs or the use of a hydraulic lock between two seals. Both can be released by actuation of the known setting tool modified for this application. The lugs become unsupported and allow movement or the shearing of a partially drilled bolt allows passage of fluid to move from one camber to the next, therefore removing the hydraulic lock.

Collets can protect the retaining sleeve from damage during running in while other collets can guide the path of the seat to ensure it winds up in the respective groove. The seat can be initially held in a central groove of segments that are radially biased to push the seat out when the covering sleeve is retracted. The locating dog is spring biased to find a locating groove and is abutted to the end of a locating groove with a pickup force. A greater applied force undermines the locating dog and allows the seat delivery tool to be pulled out of the hole. The seat can be located centrally in a groove of the extending segments or off toward one end or the other of the extending segments. The protection device for the adaptive seat sleeve can be retracted when the seat is released after protecting the sleeve and associated seat during running in. A separate collet assembly can guide the outward movement of the seat and alternatively can be used to axially advance the seat into its associated groove if the seat is released without being aligned to the respective groove. The sleeve can be moved axially away from being over the seat or the string can be moved axially relative to the covering sleeve to release the seat into its respective groove. Various tapered surfaces on the running tool can be used to engage the seat when released axially offset from the groove to advance the seat into the groove.

The delivery tool retains the ability to remove an adaptive seat from the well that fails to locate in the recess or support. This can be achieved using a simple hooked shape member on the bottom of the tool such that movement downward would allow the adaptive seat to get entangled by the hook which in turn will catch the adaptive seat and bring it back to surface.

The above description is illustrative of the preferred embodiment and many modifications may be made by those skilled in the art without departing from the invention whose scope is to be determined from the literal and equivalent scope of the claims below:

The invention claimed is:

1. A delivery tool for a support deployed in a tubular recess or a support location on the tubular for selective tubular string isolation for pressure treatment of a formation from a borehole, comprising:

a mandrel assembly comprising a longitudinal axis adapted for insertion into the tubular string;

a retaining sleeve supported by said mandrel and selectively mounted over the support to hold the support in an initial smaller dimension during insertion to the recess or support location in the tubular string, said retaining sleeve selectively relatively movable with respect to said support to an non-overlapping position with respect to said support such that said support can radially enlarge to a larger dimension where said support is positioned in part in said tubular recess or support location and in part in a passage in the tubular and clear of said mandrel assembly for removal of said mandrel assembly from the tubular string.

2. The tool of claim 1, further comprising:

at least one locating dog to engage a locating profile in the tubular string to align said support with the recess before said relative movement of said retaining sleeve.

3. The tool of claim 2, wherein:

said at least one locating dog biased radially away from said mandrel assembly and mounted on a dog sleeve supported by said mandrel assembly, said at least one locating dog engaging the locating profile to apply pullout resistance to said mandrel until a predetermined force is applied to said mandrel, whereupon a dog sleeve groove aligns with said at least one locating dog to allow removal of said mandrel assembly.

4. The tool of claim 2, wherein:

said locating dog engages said locating profile uphole of said retaining sleeve.

5. The tool of claim 2, wherein:

said locating dog engages said locating profile downhole of said retaining sleeve.

6. The tool of claim 1, wherein:

said retaining sleeve moves axially with respect to said support for said non-overlapping position.

7. The tool of claim 1, wherein:

said support moves axially with respect to said retaining sleeve for said non-overlapping position.

8. The tool of claim 6, wherein:

said retaining sleeve moves axially in tandem with an outer piston on said mandrel assembly.

9. The tool of claim 8, wherein:

said outer piston is fluid pressure driven.

10. The tool of claim 9, wherein:

said mandrel assembly further comprising an inner piston in a mandrel assembly passage, whereupon movement of said inner piston creates fluid pressure to move said outer piston and retaining sleeve to said non-overlapping position.

11. The tool of claim 10, wherein:

said inner piston is releasably locked with a lock assembly to said mandrel assembly.

12. The tool of claim 1, wherein:

said support is mounted on a plurality of radially biased segments to push said support out radially when said non-overlapping position with said retaining sleeve is reached.

13. The tool of claim 12, wherein:

said support retained in said retaining sleeve with stored potential energy therein that is at least in part released in said non-overlapping position such that movement of said support into the tubular recesses is driven by said potential energy and said radially biased segments.

14. The tool of claim 12, wherein:

said radially biased segments guided by said mandrel assembly to move said support axially to the tubular recess.

15. The tool of claim 12, wherein:

said tool retains the ability to remove an adaptive seat from the well that fails to locate in the recess or support.

16. The tool of claim 12, wherein:

an inner hydrostatic chamber is activated to move a piston and an outer sleeve to uncover the adaptive seat.

17. A delivery tool for a support deployed in a tubular recess or a support location on the tubular for selective tubular string isolation for pressure treatment of a formation from a borehole, comprising:

a mandrel assembly comprising a longitudinal axis adapted for insertion into the tubular string;

a retaining sleeve supported by said mandrel and selectively mounted over the support to hold the support in an initial smaller dimension, said retaining sleeve selectively relatively movable with respect to said support to an non-overlapping position with respect to said support such that said support can radially enlarge to a larger dimension where said support is positioned in part in said tubular recess or support location and in part in a passage in the tubular and clear of said mandrel assembly for removal of said mandrel assembly from the tubular string;

said retaining sleeve moves axially with respect to said support for said non-overlapping position;

said retaining sleeve moves axially in tandem with an outer piston on said mandrel assembly;

said outer piston is fluid pressure driven;

said mandrel assembly further comprising an inner piston in a mandrel assembly passage, whereupon movement of said inner piston creates fluid pressure to move said outer piston and retaining sleeve to said non-overlapping position;

said inner piston is releasably locked with a lock assembly to said mandrel assembly;

said lock assembly comprising a lug extending through said inner piston and said mandrel assembly, said lug supported by a release member mounted in an end recess of said inner piston and biased toward a supporting position for said lug.

18. The tool of claim 17, wherein:

said release member selectively contacted by an actuating piston to overcome said bias to undermine said lug to allow said actuating and inner pistons to move in tandem with respect to said mandrel assembly with said lug moving into a depression in said release member to keep said lug retracted in said inner piston.

19. The tool of claim 18, wherein:

said actuating piston forms a component of an E4#10 setting tool made by Baker Hughes Incorporated.

20. A delivery tool for a support deployed in a tubular recess or a support location on the tubular for selective tubular string isolation for pressure treatment of a formation from a borehole, comprising:

a mandrel assembly comprising a longitudinal axis adapted for insertion into the tubular string;

a retaining sleeve supported by said mandrel and selectively mounted over the support to hold the support in an initial smaller dimension, said retaining sleeve selectively relatively movable with respect to said support to an non-overlapping position with respect to said support such that said support can radially enlarge to a larger dimension where said support is positioned in part in said tubular recess or support location and in part in a passage in the tubular and clear of said mandrel assembly for removal of said mandrel assembly from the tubular string;

said retaining sleeve moves axially with respect to said support for said non-overlapping position;

said retaining sleeve moves axially in tandem with an outer piston on said mandrel assembly;

said outer piston is fluid pressure driven;

said mandrel assembly further comprising an inner piston in a mandrel assembly passage, whereupon movement of said inner piston creates fluid pressure to move said outer piston and retaining sleeve to said non-overlapping position;

said inner piston comprises an end cap further comprising a plurality of fingers extending adjacent said retaining sleeve to protect said retaining sleeve during running in, said end cap moving away from said retaining sleeve in said non-overlapping position of said support.

21. A delivery tool for a support deployed in a tubular recess or a support location on the tubular for selective tubular string isolation for pressure treatment of a formation from a borehole, comprising:

a mandrel assembly comprising a longitudinal axis adapted for insertion into the tubular string;

a retaining sleeve supported by said mandrel and selectively mounted over the support to hold the support in an initial smaller dimension, said retaining sleeve selectively relatively movable with respect to said support to an non-overlapping position with respect to said support such that said support can radially enlarge to a larger dimension where said support is positioned in part in said tubular recess or support location and in part in a passage in the tubular and clear of said mandrel assembly for removal of said mandrel assembly from the tubular string;

said support is mounted on a plurality of radially biased segments to push said support out radially when said non-overlapping position with said retaining sleeve is reached;

said radially biased segments comprise at least one ring of collet fingers.

* * * * *